US008744284B2

(12) United States Patent
Sakaguchi

(10) Patent No.: US 8,744,284 B2
(45) Date of Patent: Jun. 3, 2014

(54) IMAGE FORMING APPARATUS, CONTROL METHOD OF IMAGE FORMING APPARATUS, AND STORAGE MEDIUM STORING PROGRAM

(75) Inventor: Toru Sakaguchi, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 262 days.

(21) Appl. No.: 13/414,506

(22) Filed: Mar. 7, 2012

(65) Prior Publication Data

US 2012/0230709 A1 Sep. 13, 2012

(30) Foreign Application Priority Data

Mar. 9, 2011 (JP) ..... 2011-051689

(51) Int. Cl.
*G03G 15/00* (2006.01)
*G03G 15/08* (2006.01)

(52) U.S. Cl.
CPC ..... *G03G 15/556* (2013.01); *G03G 15/0831* (2013.01); *G03G 2215/00569* (2013.01)
USPC ..... 399/15; 399/14; 399/27; 399/72; 399/87

(58) Field of Classification Search
CPC ..... G03G 15/5079; G03G 15/553; G03G 15/556; G03G 2221/1663; G03G 2221/1669; G03G 15/0831; G03G 2215/00569
USPC ..... 399/15, 14, 27, 72, 87
See application file for complete search history.

(56) References Cited

U.S. PATENT DOCUMENTS 4,965,613 A * 10/1990 Morris et al. ..... 346/25
2007/0242962 A1* 10/2007 Yamamoto ..... 399/15
2007/0291286 A1* 12/2007 Utsunomiya et al. ..... 358/1.8

FOREIGN PATENT DOCUMENTS

JP 2007-118239 A 5/2007

* cited by examiner

*Primary Examiner* — David Gray
*Assistant Examiner* — Tyler Hardman
(74) *Attorney, Agent, or Firm* — Canon U.S.A., Inc., IP Division

(57) ABSTRACT

An image forming apparatus includes a printing unit configured to print an input print job including a plurality of pages, wherein, if it is determined that a remaining amount of a recording agent in a cartridge is less than or equal to a threshold value, the printing unit prints a portion of print data in the print job, temporarily stops printing, and displays a toner out message on a display unit to prompt a user to replace the cartridge, and repeats, if the user does not replace the cartridge after the toner out message is displayed, printing a portion of print data in the print job that is different from the print data that the printing unit has already printed, temporarily stopping printing, and displaying on the display unit the toner out message.

9 Claims, 9 Drawing Sheets

IMAGE FORMING APPARATUS, CONTROL METHOD OF IMAGE FORMING APPARATUS, AND STORAGE MEDIUM STORING PROGRAM

BACKGROUND OF THE INVENTION

1. Field of the Invention

The present invention relates to an image processing technique of an image forming apparatus capable of printing a print job according to a print command and reprinting the print job according to a reprint command.

2. Description of the Related Art

When print data is to be printed, a stain on a printing paper or difference in color may be generated in a printed product. A user visually confirming the printed product may then be dissatisfied with the result.

In such a case, it becomes necessary for the user to re-transmit the same job from a host personal computer (PC) to a printer to output another printed product after confirming the printed product. Further, the host PC and the printer are required to perform the same printing process as the previous process in reprinting the print data.

In particular, if the host PC and the printer are located far apart, it becomes necessary for the user to walk back and forth between the host PC and the printer to re-transmit the same job to the printer.

To solve such a problem, Japanese Patent Application Laid-Open No. 2007-118239 discusses a technique in which the printer temporarily stores the data that has been once printed without deleting the data, so that the data can be reprinted by operating on the printer. In the above-described technique, the printer is capable of storing, when temporarily storing the print data, the print data corresponding to each job, and performing reprinting of the stored print data corresponding to a transmitted job or a plurality of jobs.

Further, in a normal printer, a toner remaining amount measurement unit measures a remaining amount of toner in a toner cartridge. If the toner remaining amount measurement unit detects that the remaining amount of toner is less than or equal to a threshold value, the printer determines that the toner has run out, and an error display determination unit then determines that an error has occurred. Upon determining the error, a display unit displays to the user that the printer is in a "toner run out (i.e., toner out)" state, and prompts the user to replace the toner cartridge.

However, when the display unit is displaying "toner out", it does not necessarily indicate that there actually is no toner at all in the cartridge. In other words, the remaining amount of toner which is less than or equal to the threshold value may be a sufficient amount for printing to be performed without the print result becoming faint.

There are users who desire to print until immediately before the print result becomes faint and replace the toner cartridge after confirming that the print result has started to become faint.

For example, it is assumed that a user, who prints until immediately before the print result becomes faint, transmits 100 pages of a print job to the printer. Further, while the printer is performing the received job, the print result on the paper becomes faint from page 21, so that the user acquires a printed product in which the print results of page 21 to page 100 are faint.

If the user is not satisfied with the faint print results of page 21 to page 100, the user replaces the current toner cartridge to a new toner cartridge and reprints the job on the printer from the beginning, using the above-described reprinting function.

As a result, the user can acquire a printed product in which the print results of page 21 to page 100 are not faint.

However, if the user cannot replace the toner cartridge until the printer completes printing of the transmitted job, it does not answer the user's demand to be able to replace the cartridge after confirming that the print result has started to become faint. In other words, the user cannot completely use the toner in the cartridge.

Further, when the printer performs initial printing of the job, 80 sheets of paper and time used for printing page 21 to page 100, in which the toner has become faint, become useless. Furthermore, if the user is satisfied with the printing result of the first 20 pages acquired in initial printing, the printing results of the first 20 pages acquired by the printer performing reprinting after the user replaces the cartridge become useless.

The above-described problem is not limited to the printer using the toner and similarly occurs in a printer using a recording agent such as ink.

SUMMARY OF THE INVENTION

An aspect of the present invention is directed to an image forming apparatus capable of printing a print job according to a print command and reprinting the print job according to a reprint command.

According to an aspect of the present invention, an image forming apparatus includes a printing unit configured to print an input print job including a plurality of pages, wherein, if it is determined that a remaining amount of a recording agent in a cartridge is less than or equal to a threshold value the printing unit prints a portion of print data in the print job, temporarily stops printing, and displays a toner out message on a display unit to prompt a user to replace the cartridge, and repeats, if the user does not replace the cartridge after the toner out message is displayed, printing a portion of print data in the print job that is different from the print data that the printing unit has already printed, temporarily stopping printing, and displaying on the display unit the toner out message.

According to an exemplary embodiment of the present invention, the image forming apparatus temporarily repeats stopping printing and displaying a message each time a predetermined number of pages in the print job is printed. As a result, the user can determine whether to replace the cartridge every time a predetermined number of pages in the print job are printed. Unnecessary use of paper and recording agent (i.e., output of the printed product in which the print result is faint) can thus be reduced.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

An image forming apparatus according to a first exemplary embodiment of the present invention will be described below with reference to the drawings.

According to the present exemplary embodiment, a print job includes header information for performing printing (e.g., a number of pages or a paper size) and print data to be printed. The print data includes data corresponding to a plurality of pages of printing paper.

Further, according to the present exemplary embodiment, the image forming apparatus includes a "toner overuse" function. Such a function provides a user with the ability to print until immediately before the print result becomes faint, and to replace the toner cartridge after confirming that the print result has started to become faint. In other words, printing can continue even after the "toner out" message is displayed on the display unit.

However, the image forming apparatus including such a function cannot previously detect and notify the user of the amount of printing that can be performed before the print result starts to become faint when overusing the toner.

Further, the image forming apparatus including such a function can be caused to shift to a toner overuse state. More specifically, if the image forming apparatus displays the toner out message on the display unit, and the user sets the apparatus to a toner overuse mode without replacing the toner cartridge corresponding to the toner being displayed, the apparatus can be caused to shift to the toner overuse state. The user thus continues printing by understanding that print quality of the printed output may be deteriorated when the toner is being overused.

As a result, when the toner out message is displayed on a normal printer, the printer continues displaying the message until the user replaces the cartridge. If the user then selects the toner overuse mode, the printer may end displaying the toner out message.

Figure 1:
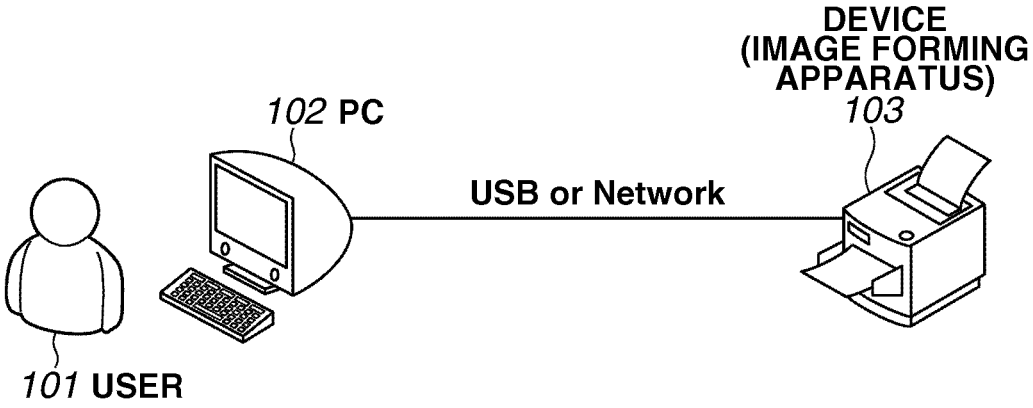
FIG. 1 illustrates an overall configuration according to an exemplary embodiment of the present invention.

FIG. 1 illustrates an environment for implementing the first exemplary embodiment.

Referring to FIG. 1, a device (i.e., an image forming apparatus) 103 is connected to a PC 102 via a universal serial bus (USB) or a network. A user 101 operates an operation unit 206 in the PC 102 or an operation unit 316 in the device 103 to specify an arbitrary setting on or issue an arbitrary instruction to the device 103.

Figure 2:
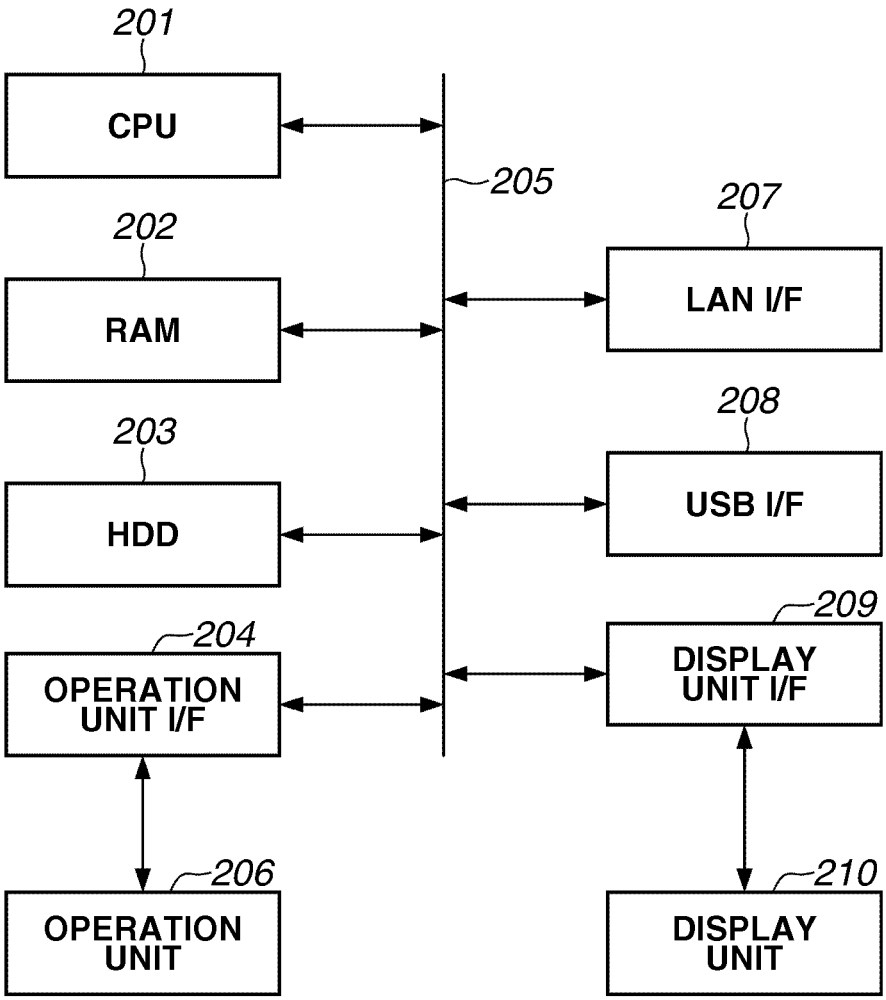
FIG. 2 is a block diagram illustrating a control configuration of the PC.

FIG. 2 illustrates a hardware configuration of the PC 102 according to the present exemplary embodiment.

Referring to FIG. 2, a central processing unit (CPU) 201 is a processor which controls the entire system. A random access memory (RAM) 202 is a system work memory for the CPU 201 to operate, and is used as a program memory to record programs. A hard disk drive (HDD) 203 is a data storing area.

An operation unit interface (I/F) 204, which is an interface to an operation unit 206, receives input signals from the operation unit 206. Further, the operation unit I/F 204 transmits to the CPU 201 information input by the user on the operation unit 206. A display unit I/F 209, which is an interface to a display unit 210, outputs to the display unit 210 output signals according to control performed by the CPU 201.

A USB I/F 208 is a functional unit for connecting to a USB device, and is used to acquire a status of another device or return the status via the USB. A local area network (LAN) I/F 207 is a functional unit for connecting to the LAN, and is used to acquire a status of another device or return the status via the LAN. The above-described components are disposed on a system bus 205.

Figure 3:
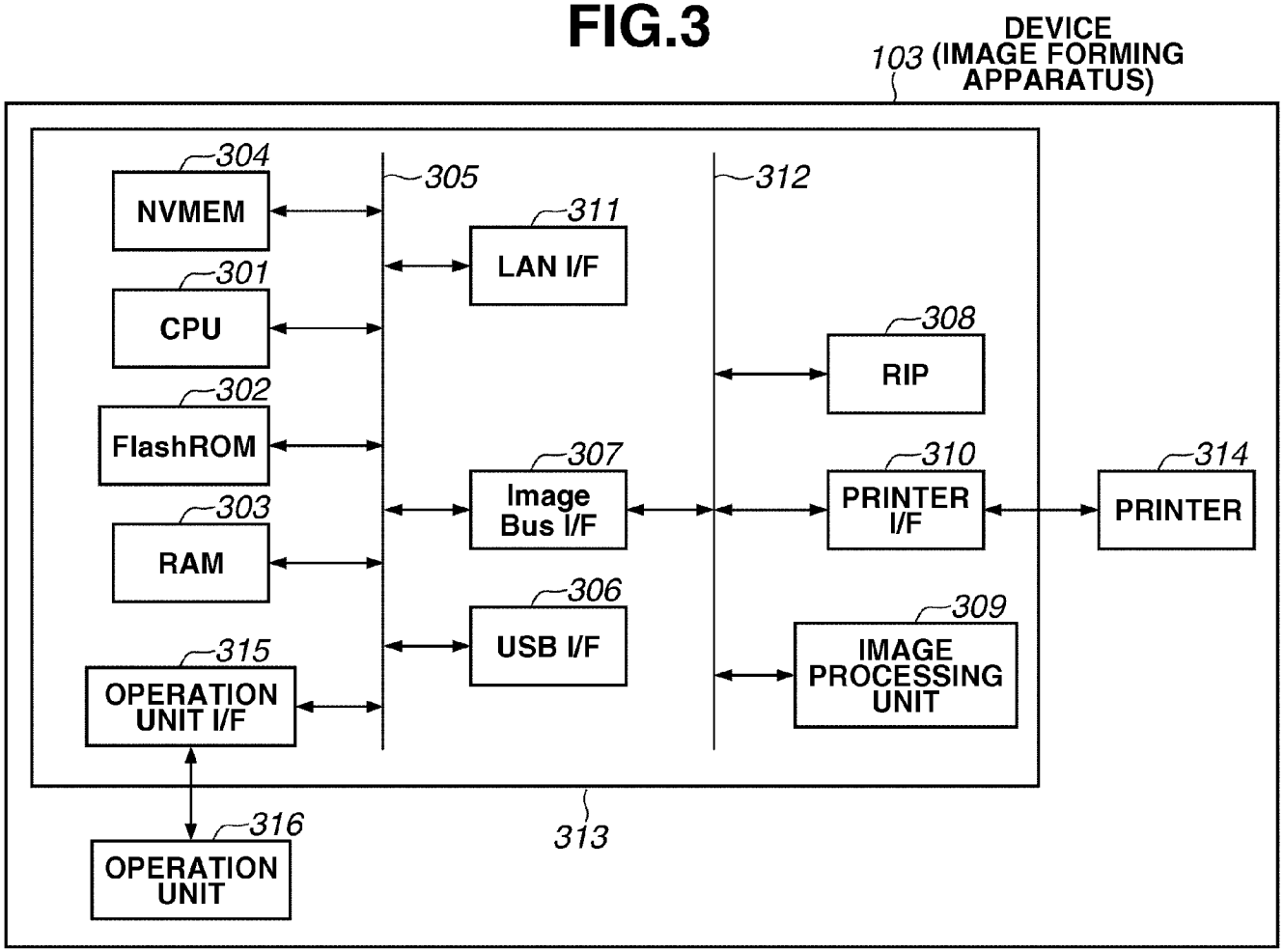
FIG. 3 is a block diagram illustrating a control configuration of a device including a controller unit.

FIG. 3 illustrates a hardware configuration of a controller unit 313 in the device 103 according to the present exemplary embodiment.

Referring to FIG. 3, the controller unit 313, which is connected to a printer 314 functioning as an image output device, inputs to and outputs from the PC 102 and the printer the image data and device information. Further, the controller unit 313 becomes capable of receiving arbitrary settings and instructions from the user by connecting to an operation unit 316.

The CPU 301 is a processor for controlling the entire system. The RAM 303 functions as a system work memory for the CPU 301 to operate, a program memory for recording the programs, and an image memory for temporarily storing the image data.

A non-volatile memory (NVMEM) 304 is used for recording setting information. A flash read-only memory (flash ROM) 302 is a rewritable non-volatile memory that stores various control programs for controlling the system.

An operation unit I/F 315, which is an interface to the operation unit 316, receives the input signals from the operation unit 316. Further, the operation unit I/F 315 transmits to the CPU 301 the information input by the user to the operation unit 316. A USB interface 306 connects to the PC 102 via the USB.

A LAN I/F 311 connects the device 103 to the PC 102 via the LAN. The above-described components are disposed on a system bus 305. An image bus I/F 307 is a bus bridge that connects the system bus 305 to an image bus 312 that transfers the image data at high speed, and converts a data structure. The image bus 312 is formed of a protocol control information (PCI) bus or Institute of Electrical and Electronics Engineers (IEEE) 1394. The components described below are disposed on the image bus 312.

A raster image processor (RIP) 308 rasterizes vector data, such as a page-description language (PDL) code, to a bitmap image. A printer I/F 310 connects the printer 314 and the controller unit 313, and performs synchronous/asynchronous conversion of image data or exchange of data.

An image processing unit 309 corrects, processes, and edits input image data, and performs correction and resolution conversion on the printer with respect to output image data to be printed. Further, the image processing unit 309 rotates the image data, and performs joint photographic experts group (JPEG) compression and decompression on multivalued image data, and joint bi-level image experts group (JBIG), modified modified relative element address designate (MMR), and modified Hoffman (MH) compression and decompression on binary image data.

The printer 314 converts raster image data to an image on the paper. The printer 314 may employ any printing method, such as an electrophotographic method using a photosensitive drum and a photosensitive belt member, or an inkjet method in which ink is discharged from minute nozzle arrays to directly print the image on the paper. A print operation is started by an instruction from the CPU 301.

FIGS. 4, 5, 6, and 7 illustrate screens of an UI application which operates on the PC 102.

According to the present exemplary embodiment, the user sets an ON/OFF status of a reprint mode using the UI application. Further, the user sets, by using the UI application, the number of pages to be printed where the device 103 is to temporarily stop printing each time and wait for a user's confirmation when the reprint mode of the device 103 is set to be ON and overusing the toner. The settings are stored in the RAM 202.

According to the present exemplary embodiment, it is assumed for description purposes that when the toner is being overused, the device 103 temporarily stops printing each time the device 103 prints "n" pages, and waits for the user's confirmation. Further, according to the present exemplary embodiment, the user manually activates the UI application using the operation unit 206 in the PC 102 to specify the settings.

Figure 4:
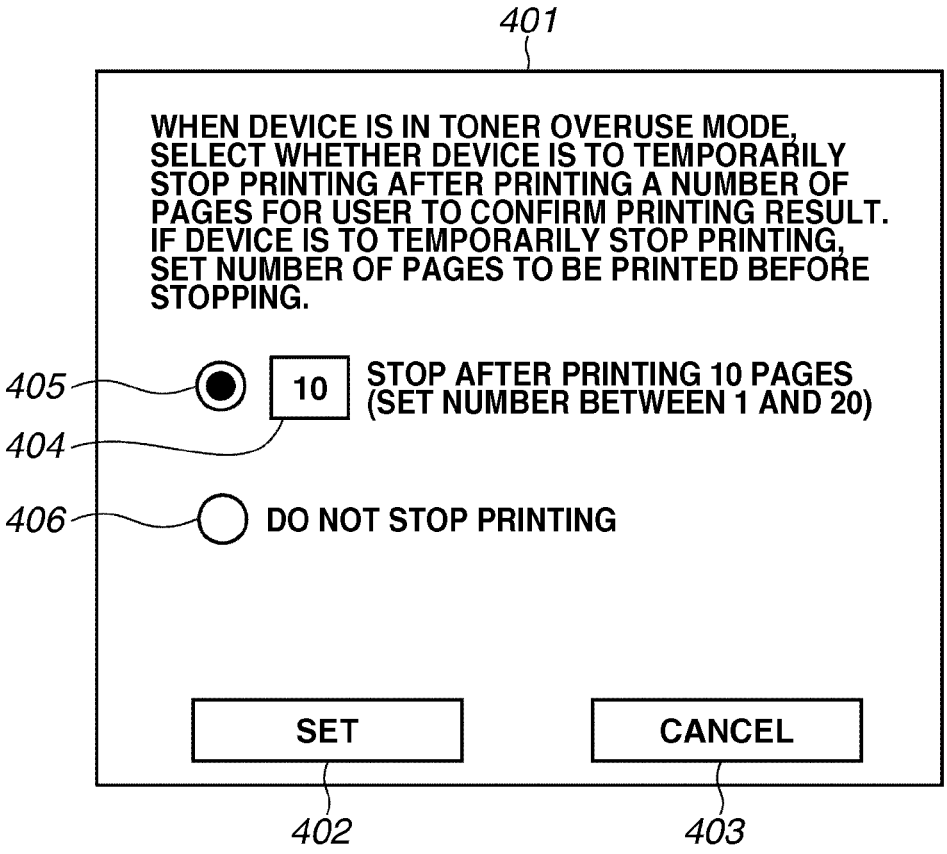
FIG. 4 illustrates an example of a user interface (UI) application screen used by the user for specifying a setting.
Figure 5:
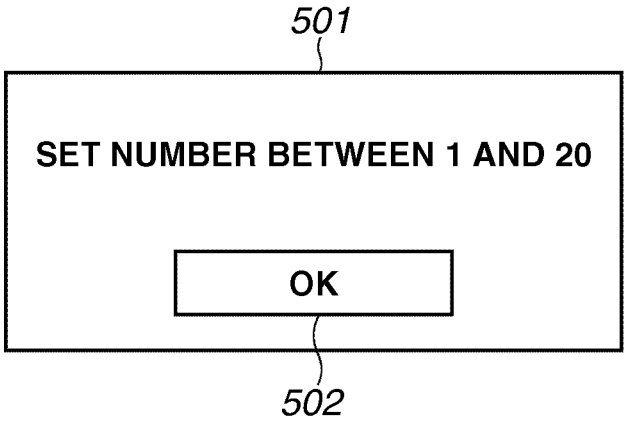
FIG. 5 illustrates an example of a confirmation dialog screen displayed when the user specifies a setting.
Figure 6:
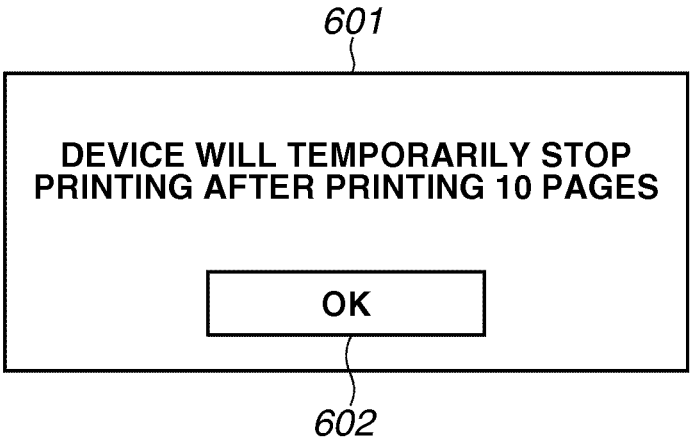
FIG. 6 illustrates an example of a confirmation dialog screen displayed when the user specifies a setting.

Referring to FIG. 4, the user selects either radio button 405 or 406 in a dialog 401. If the user selects the radio button 405, the user inputs, by using the operation unit 206 in the PC 102, an arbitrary value of "n" in an edit box 404. For example, the user may select the radio button 405 in the dialog 401, input in the edit box 404 a value which is less than one or greater than or equal to 21 (According to the present exemplary embodiment, 10 is input.), and press a set button 402. In such a case, the PC 102 displays a dialog 501 illustrated in FIG. 5, and if the user presses an OK button 502, the dialog 501 is closed.

The user may also select the radio button 405 in the dialog 401, input in the edit box 404 a value greater than or equal to one and less than or equal to 20, and press the set button 402. In such a case, the PC 102 displays a dialog 601 illustrated in FIG. 6, and the reprint mode is set to ON. If the user then presses an OK button 602, the dialog 601 and the dialog 401 are closed.

Figure 7:
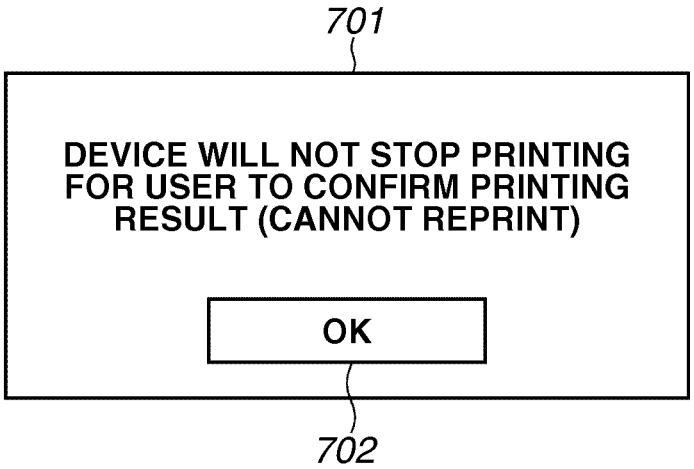
FIG. 7 illustrates an example of a confirmation dialog screen displayed when the user specifies a setting.

If the user selects the radio button 406 and presses the set button 402 in the dialog 401, the PC 102 displays a dialog 701 illustrated in FIG. 7, and the reprint mode is set to OFF. If the user then presses an OK button 702, the dialog 701 and the dialog 401 are closed.

The ON/OFF setting and the value of "n" of the reprint mode are transmitted from the LAN I/F 207 or the USB I/F 208 in the PC 102 to the LAN I/F 311 or the USB I/F 306 of the device 103 and stored in the NVMEM 304.

According to the present exemplary embodiment, a maximum value of "n" is set to 20. However, the maximum value changes according to specification of the image forming apparatus. It is desirable to set the maximum value of "n" to match a maximum capacity of a buffer acquired in the NVMEM 304 for temporarily storing the data of the job to be reprinted.

Figure 8:
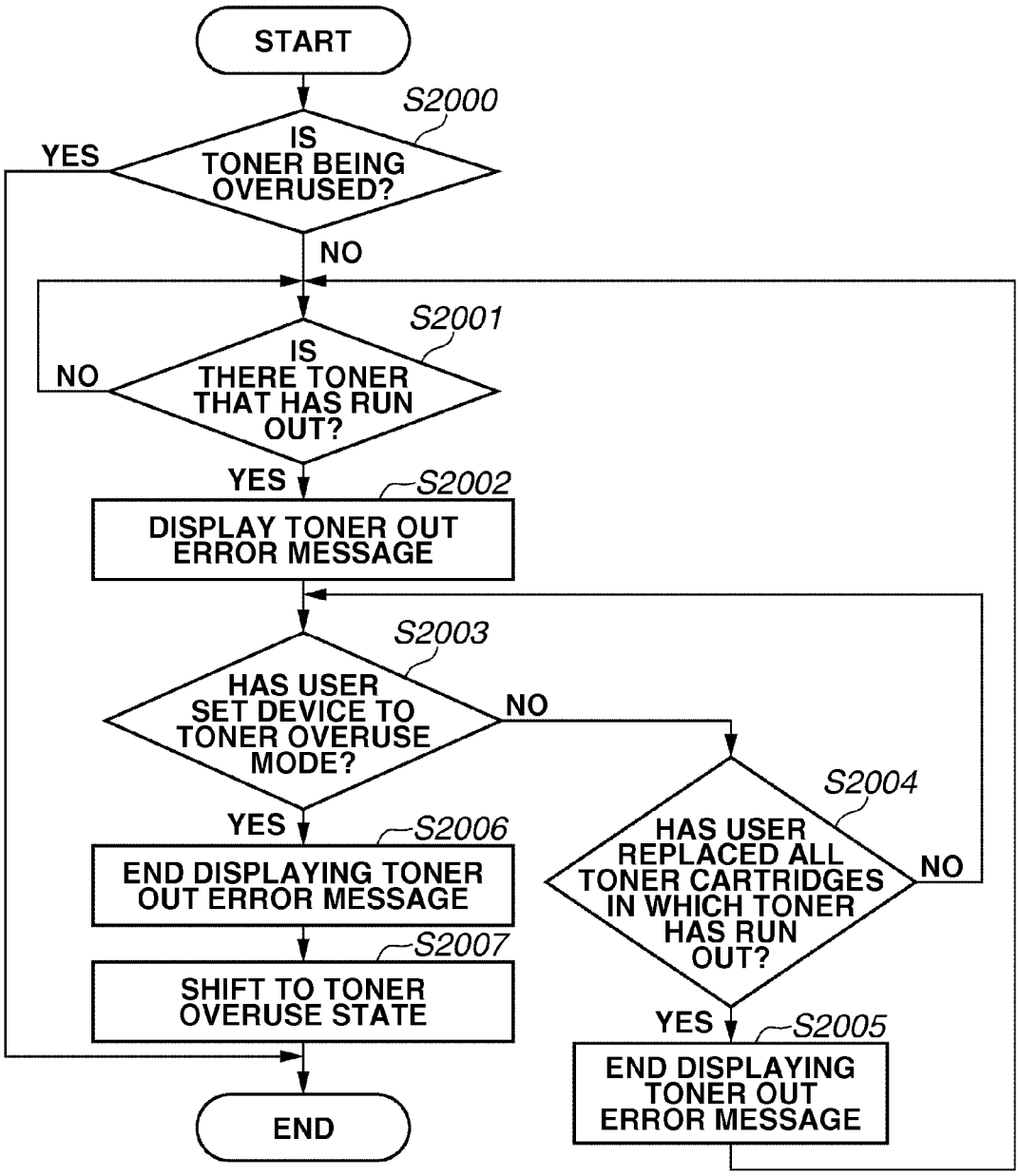
FIG. 8 is a flowchart illustrating a process performed when the controller unit shifts to a toner overuse state.

FIG. 8 is a flowchart illustrating the process performed when the device 103 shifts to the toner overuse state.

The controller unit 313 in the device 103 is constantly polling the determination process, as described below. In step S2000, the controller unit 313 loads the ON/OFF setting of the toner overuse mode stored in the RAM 202 and determines whether the toner is being overused.

If the toner is being overused (YES in step S2000), the process ends. The controller unit 313 determines whether the toner is being overused based on the information on the toner overuse stored in the NVMEM 304, as described with reference to FIGS. 4 and 6.

If the toner is not being overused (NO in step S2000), the process proceeds to step S2001. In step S2001, the controller unit 313 determines whether the toner has run out (i.e., as toner out). There are various methods for determining whether toner has run out, such as a toner remaining amount measurement unit (not illustrated) measuring the remaining amount of toner in the cartridge. If it is detected, as a result of measuring, that the toner is less than or equal to the threshold value, it is determined that the toner has run out (i.e., is toner out). The threshold value is determined according to a design of the apparatus or a usage environment of the user.

If it is determined that the toner has not run out (NO in step S2001), the process repeats performing determination of whether the toner has run out. If toner has b run out (YES in step S2001), toner out status information is transmitted from the LAN I/F 311 or the USB I/F 306 in the device 103 to the LAN I/F 207 or the USB I/F 208 in the PC 102.

In step S2002, the controller 313 displays an error message on the display unit 210 in the PC 102, and a toner out message on the operation unit 316 in the device 103. In step S2003, the controller unit 313 determines whether the user has set the device 103 to the toner overuse mode.

The user sets the device 103 to the toner overuse mode using the operation unit 206 in the PC 102. The setting is then transmitted from the LAN I/F 207 or the USB I/F 208 in the PC 102 to the LAN I/F 311 or the USB I/F 306 in the device 103, and is stored in the RAM 202. Further, the user can set the device 103 to the toner overuse mode using the operation unit 316 in the device 103.

If the user has set the device 103 to the toner overuse mode (YES in step S2003), the process proceeds to step S2006. In step S2006, the controller unit 313 stops displaying the toner out message. In step S2007, the controller unit 313 shifts the device 103 to the toner overuse state. The process then ends.

If the user has not set the device 103 to the toner overuse mode (NO in step S2003), the process proceeds to step S2004. In step S2004, the controller unit 313 determines whether the user has replaced all of the toner cartridges in which the toner has been determined to be out. If the user has not replaced all of the toner cartridges in which the toner has been determined to be out (NO in step S2004), the process returns to step S2003. On the other hand, if the user has replaced all of the toner cartridges in which the toner has been determined to be out (YES in step S2004), the process proceeds to step S2005. In step S2005, the controller unit 313 stops displaying the toner out error message. The process then returns to step S2001, and the controller unit 313 determines whether the toner is out.

Figure 9:
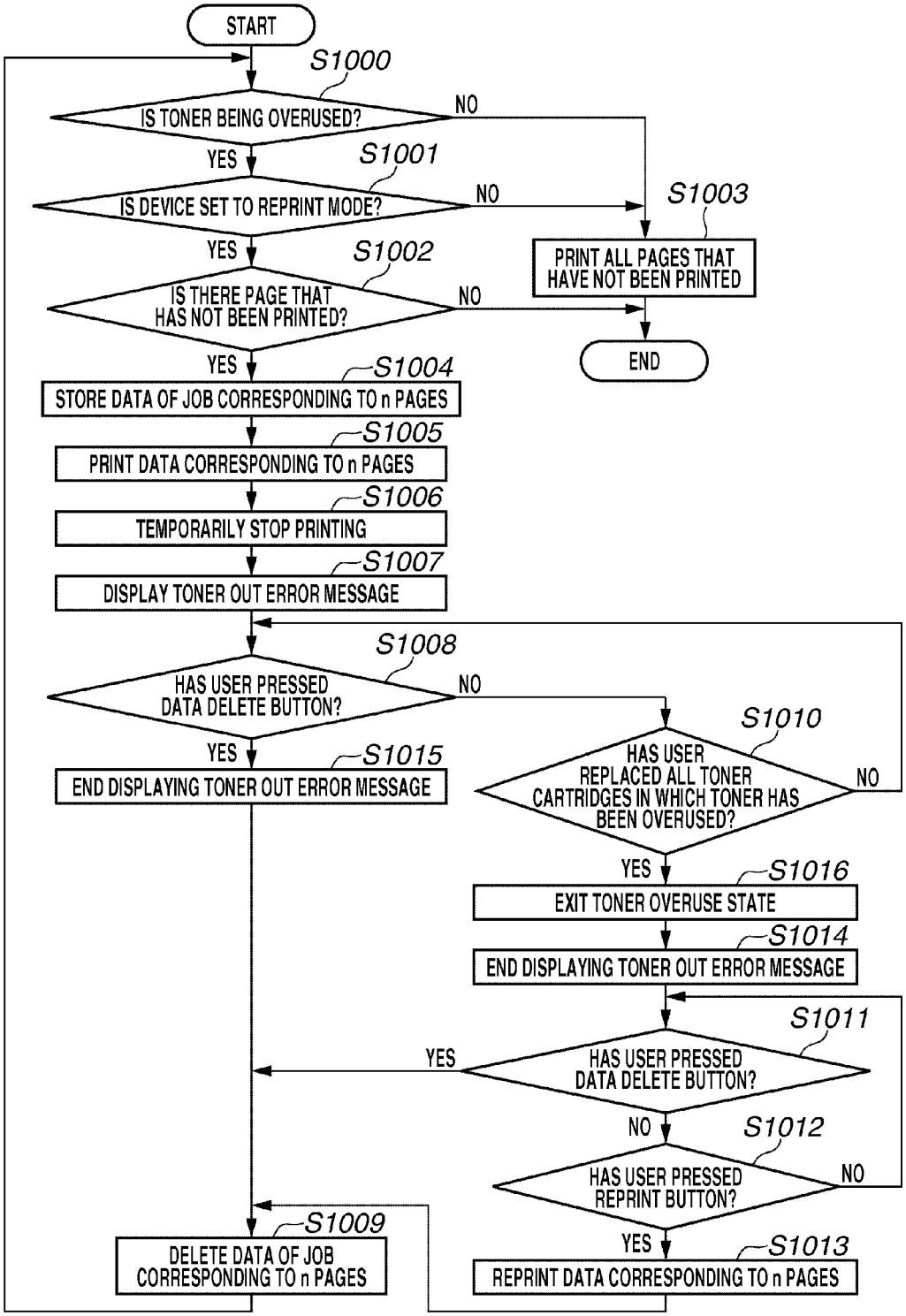
FIG. 9 is a flowchart illustrating a process for determining whether the device is to reprint a print job.

FIG. 9 is a flowchart illustrating a process for performing the print job according to the present exemplary embodiment.

According to the process of the flowchart illustrated in FIG. 9, the device 103 divides the print job transmitted from the PC 102 into data corresponding to the designated "n" pages. The device 103 then determines whether to temporarily store the data, stores the temporarily stored data corresponding to each "n" page, and temporarily stops printing after printing "n" pages. The device 103 then allows the user to determine whether to reprint the data each time the device 103 temporarily stops printing.

The controller unit 313 in the device 103 performs the determination process described below every time the print job is received. Further, the PC 102 may divide the print data to "n" pages each, so that the device 103 receives, stores, and prints every "n" pages.

In step S1000, the controller unit 313 determines whether the toner is being overused. If the toner is not being overused (NO in step S1000), the process proceeds to step S1003. In step S1003, the controller unit 313 prints all of the pages that have not been printed. The process then ends.

If the toner is being overused (YES in step S1000), the process proceeds to step S1001. In step S1001, the CPU 301 loads the ON/OFF setting of the reprint mode stored in the NVMEM 304 and determines whether the device 103 is set to the reprint mode.

If the device 103 is not set to the reprint mode (NO in step S1001), the process proceeds to step S1003. In step S1003, the controller unit 313 prints all of the pages that have not been printed. The process then ends. On the other hand, if the device 103 is set to the reprint mode (YES in step S1001), the process proceeds to step S1002. In step S1002, the controller unit 313 determines whether there are pages that have not yet been printed. If all of the pages have been printed (NO in step S1002), the process ends.

If there are pages that have not been printed (YES in step S1002), the process proceeds to step S1004. In step S1004, the CPU 301 loads the value of "n" stored in the NVMEM 304, and stores in the RAM 303 the image data corresponding to "n" pages which has been rendered among the data of a plurality of pages included in the job. In step S1005, the controller unit 313 prints the data corresponding to "n" pages (i.e., each of the divided print data) set by the user using the dialog 401 illustrated in FIG. 4. In step S1006, the controller unit 313 temporarily stops printing.

In step S1007, the controller unit 313 issues from the LAN I/F 311 or the USB I/F 306 in the device 103 to the LAN I/F 207 or the USB I/F 208 in the PC 102 an instruction to display the toner out error message. The controller unit 313 thus causes the display unit 210 in the PC 102 to display the toner out error message. Further, the controller unit 313 also causes the operation unit 316 in the device 103 to display the toner out error message.

In general, a printer including a toner overuse function displays, when toner has run out, a toner out error message on a display unit in a host PC or an operation unit in the printer. The printer stops displaying the error message when the printer enters a toner overuse state. On the other hand, according to the present exemplary embodiment, the toner out error message is displayed again when the controller unit 313 temporarily stops printing (i.e., performs the process of step S1006). The toner out error message is displayed again since it is desirable at that timing to prompt the user to replace the toner cartridge.

In such a case, the user can select from three choices as described below. The user may choose to continue printing the next "n" pages using the current toner cartridge, which was indicated to have run out, without replacing it. A user would typically select this option if the user is satisfied with the printing result of the previous "n" pages that has printed and determines that it would unlikely for the print result to become faint even when the next "n" pages are printed.

The user may choose to replace the toner cartridge without reprinting the previous "n" pages. The user thus prints the next "n" pages using a new toner cartridge. A user would typically select this option if the user is satisfied with the printing result of the previous "n" pages and determines that the print result may become faint in printing the next "n" pages.

The user may choose to replace the toner cartridge and reprint the previous "n" pages using the new toner cartridge. A user would typically select this option if the user is not satisfied with the printing result of the previous "n" pages.

In step S1008, the controller unit 313 determines whether the user has pressed a data delete button. If the user has pressed the data delete button (YES in step S1008), the process proceeds to step S1015. In step S1015, the controller unit 313 stops displaying the toner out error message, and, in step S1009, deletes the data corresponding to "n" pages of the job stored in the RAM 303. The process then returns to step S1000, and the controller unit 313 in the device 103 determines whether the toner is being overused.

Such a process corresponds to the first of the above-described three choices to be selected by the user (i.e., the user is satisfied with the currently acquired print result and desires to print the next "n" pages using the same toner cartridge).

If the user has not pressed the data delete button (NO in step S1008), the process proceeds to step S1010. In step S1010, the controller unit 313 determines whether the user has replaced all toner cartridges in which the toner has been overused. If the user has not replaced all toner cartridges in which the toner has been overused (NO in step S1010), the process returns to step S1008 to determine whether the user has pressed the data delete button. If the user has replaced all toner cartridges in which the toner has been overused (YES in step S1010), the process proceeds to step S1016. In step S1016, the controller unit 313 exits the toner overuse state. In step S1014, the controller unit 313 then ends displaying the toner out error message. In step S1011, the controller unit 313 determines whether the user has pressed the data delete button.

If the user has pressed the data delete button (YES in step S1011), the process proceeds to step S1009. In step S1009, the controller unit 313 deletes the data of the job corresponding to "n" pages stored in the RAM 303. The process then returns to step S1000, and the controller unit 313 determines whether the toner is being overused. Such a process corresponds to the second of the above-described three choices to be selected by the user (i.e., the user is satisfied with the currently acquired print result and desires to print the next "n" pages using the new toner cartridge).

If the user has not pressed the data delete button (NO in step S1011), the process proceeds to step S1012. In step S1012, the controller unit 313 determines whether the user has pressed a reprint button. If the user has not pressed the reprint button (NO in step S1012), the process returns to step S1011, and the controller unit 313 determines whether the user has pressed the data delete button.

If the user has pressed the reprint button (YES in step S1012), the process proceeds to step S1013. In step S1013, the CPU 301 loads the data corresponding to "n" pages stored in the RAM 303 and reprints the loaded data. In step S1009, the CPU 301 deletes the data corresponding to "n" pages stored in the RAM 303. The process then returns to step S1000, and the controller unit 313 in the device 103 determines whether the toner is being overused. Such a process corresponds to the third of the above-described three choices to be selected by the user (i.e., the user is not satisfied with the currently acquired print result and desires to print using the new toner cartridge).

Further, when the device 103 is to perform reprinting, the user may designate, using the operation unit 206 or the operation unit 316, the number of pages that the user is not satisfied with from among the "n" pages so that only the pages that the user is satisfied with are printed instead of printing "n" pages.

According to the present exemplary embodiment, the print data is stored by being divided into data corresponding to a predetermined number of pages. The device 103 then temporarily stops printing after printing the predetermined number of pages so that the user can determine at that time whether to reprint the predetermined pages.

As a result, users are able to print until the print result becomes faint, and replace the toner cartridge when confirming that the print result has started to become faint. This can be realized even when the toner is being overused so that the amount of printing to be performed before the print result starts to become faint cannot be previously determined.

If the user is not satisfied with the current print result, it becomes necessary to only reprint "n" pages, so that unnecessary use of paper (i.e., outputting of the printed product in which the print result is faint) can be reduced when the toner is being overused.

Further, if the rendered data is to be temporarily stored for each job, it becomes necessary for a large number of memories to be installed in the printer. However, according to the present exemplary embodiment, a set number of pages of data is temporarily stored so that the amount of memory to be installed for temporarily storing the data can be reduced.

Furthermore, when reprinting is to be performed, the device 103 does not start reprinting until the user has replaced all of the toner cartridges in which the toner is being overused. It thus prevents unnecessary reprinting in the case where the user erroneously presses the reprint button before replacing the toner cartridge.

Moreover, the user can set the reprint mode ON and OFF, and set the number of pages to be printed before the device temporarily stops printing and waits for the user's confirmation when the toner is being overused. High usability is thus provided to the user.

The print job according to the first exemplary embodiment is described above with reference to the flowchart illustrated in FIG. 9. According to a second exemplary embodiment, a process performed when the user cancels the job while the device 103 is printing "n" pages of the data (performed in step S1005 illustrated in FIG. 9) will be described below.

If the user cancels the job while the device 103 is printing "n" pages of the data (i.e., before completing printing), it is determined that the user is not satisfied with the print result. In such a case, the process proceeds to step S1008, i.e., displaying of the toner out error message, similarly as when the "n" pages of the data were completely printed in step S1005.

According to the present exemplary embodiment, the device 103 can perform reprinting even when the user has cancelled the job while the device 103 is printing "n" pages of data (in step S1005). Unnecessary usage of printing paper and time for printing can thus be reduced, and higher usability can be provided to the user.

In the above-described exemplary embodiments, the toner used in electrophotographic printing is described as an example of a recording agent. However, the recording agent used in printing is not limited to the toner and may be any other type of recording agent, such as ink.

Aspects of the present invention can also be realized by a computer of a system or apparatus (or devices such as a CPU or MPU) that reads out and executes a program recorded on a memory device (computer-readable medium) to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium). In such a case, the system or apparatus, and the recording medium where the program is stored, are included as being within the scope of the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-051689 filed Mar. 9, 2011, which is hereby incorporated by reference herein in its entirety.

What is claimed is:

1. An image forming apparatus comprising:

a printing unit configured to print an input print job including a plurality of pages, wherein, if it is determined that a remaining amount of recording agent in a cartridge is less than or equal to a threshold value, the printing unit prints a portion of print data in the print job, temporarily stops printing, and displays a toner out message on a display unit to prompt a user to replace the cartridge, and repeats, if the user does not replace the cartridge after the toner out message is displayed, printing a portion of print data in the print job that is different from the print data that the printing unit has already printed, temporarily stopping printing, and displaying on the display unit the toner out message.

2. The image forming apparatus according to claim 1, further comprising a storing unit configured to store a portion of print data in the print job, wherein the printing unit prints, using the portion of print data stored in the storing unit, temporarily stops printing, and deletes, if the user does not replace the cartridge after the toner out message is displayed, the portion of print data stored in the storing unit.

3. The image forming apparatus according to claim 1, further comprising a storing unit configured to store a portion of print data in the print job, wherein the printing unit prints, using the portion of print data stored in the storing unit, temporarily stops printing, and prints, if the user replaces the cartridge after the toner out message is displayed, the portion of print data stored in the storing unit.

4. The image forming apparatus according to claim 1, wherein, when a portion of print data in the print job including a plurality of pages is to be printed, a number of pages included in the portion of print data is set on a display unit.

5. A method for controlling an image forming apparatus configured to print an input print job including a plurality of pages, the method comprising:

printing, if it is determined that a remaining amount of a recording agent in a cartridge is less than or equal to a threshold value, a portion of print data in the print job, temporarily stopping printing, and displaying on a display unit a toner out message to prompt a user to replace the cartridge; and repeating, if the user does not replace the cartridge after the toner out message is displayed, printing a portion of print data in the print job which is different from the print data that has already been printed, temporarily stopping printing, and displaying on the display unit the toner out message.

6. The method according to claim 5, further comprising:

storing a portion of print data in the print job; and printing using the stored portion of print data, temporarily stopping printing, and deleting, if the user does not replace the cartridge after the toner out message is displayed, the stored portion of print data.

7. The method according to claim 5, further comprising:

storing a portion of print data in the print job; and printing using the stored portion of print data, temporarily stopping printing, and deleting, if the user replaces the cartridge after the toner out message is displayed, the stored portion of print data.

8. The method according to claim 5, wherein, when a portion of print data in the print job including a plurality of pages is to be printed, a number of pages included in the portion of print data is set on a display unit.

9. A computer-readable storage medium storing a program for causing a computer to perform the method according to claim 5.

* * * * *